US009272391B2

(12) United States Patent
Park

(10) Patent No.: US 9,272,391 B2
(45) Date of Patent: Mar. 1, 2016

(54) SODIUM BICARBONATE PUCK CLEANING AND PAINTING

(75) Inventor: Geun Rok Park, Busan (KR)

(73) Assignee: NIKE, Inc., Beaverton, OR (US)

( * ) Notice: Subject to any disclaimer, the term of this patent is extended or adjusted under 35 U.S.C. 154(b) by 840 days.

(21) Appl. No.: 13/115,634

(22) Filed: May 25, 2011

(65) Prior Publication Data

US 2012/0302140 A1 Nov. 29, 2012

(51) Int. Cl.

| | |
|---|---|
| ***B05D 3/12*** | (2006.01) |
| ***B05D 5/10*** | (2006.01) |
| ***B24C 1/08*** | (2006.01) |
| ***A43B 13/04*** | (2006.01) |
| ***A43B 13/20*** | (2006.01) |
| ***A43D 999/00*** | (2006.01) |
| ***B24C 1/00*** | (2006.01) |
| ***B24C 7/00*** | (2006.01) |
| *B05D 3/00* | (2006.01) |

(52) U.S. Cl.

CPC ..... *B24C 1/086* (2013.01); *A43B 13/04* (2013.01); *A43B 13/20* (2013.01); *A43D 999/00* (2013.01); *B24C 1/003* (2013.01); *B24C 7/0046* (2013.01); *B05D 3/002* (2013.01); *B05D 3/12* (2013.01); *B05D 5/10* (2013.01)

(58) Field of Classification Search

CPC ..... B05D 3/002; B05D 3/12; B05D 5/02; B05D 5/10; B24C 1/086; B24C 7/0046; A43D 999/00

USPC ..... 427/299, 322, 289, 290, 327

See application file for complete search history.

(56) References Cited

U.S. PATENT DOCUMENTS

| | | | | |
|---|---|---|---|---|
| 3,242,515 | A | | 3/1966 | Baeten et al. |
| 3,504,079 | A | | 3/1970 | Hall |
| 3,638,785 | A | * | 2/1972 | Casteel et al. ..... 206/229 |
| 4,873,049 | A | | 10/1989 | Landwehr et al. |
| 4,878,320 | A | | 11/1989 | Woodson |
| 5,081,799 | A | | 1/1992 | Kirschner et al. |
| 5,265,383 | A | | 11/1993 | Shank, Jr. |
| 5,308,403 | A | | 5/1994 | Yam et al. |
| 5,308,404 | A | | 5/1994 | Yam et al. |
| 5,316,587 | A | | 5/1994 | Yam et al. |
| 5,322,532 | A | | 6/1994 | Kurtz |
| 5,332,447 | A | | 7/1994 | Winston et al. |
| 5,366,560 | A | | 11/1994 | Rubey, III et al. |
| 5,407,379 | A | | 4/1995 | Shank et al. |
| 5,591,064 | A | | 1/1997 | Spears, Jr. |

(Continued)

FOREIGN PATENT DOCUMENTS

| | | |
|---|---|---|
| WO | WO94/16835 | 8/1994 |
| WO | WO97/49525 | 12/1997 |

*Primary Examiner* — Kirsten Jolley

(74) *Attorney, Agent, or Firm* — Honigman Miller Schwartz & Cohn LLP

(57) ABSTRACT

An article of footwear is made by (a) providing a component having a contaminant on a receiving area of a surface; (b) blast cleaning the receiving area of the surface by propelling an abrasive alkali, alkaline earth, or ammonium compound in a pressurized gas stream against the receiving area; (c) applying a pressurized gas stream free of the abrasive compound, liquid water, and organic liquid to the receiving area to remove any residual abrasive compound from the receiving area of the surface to produce a cleaned receiving area; (d) applying a layer of material to the cleaned receiving area, wherein the material is selected from the group consisting of adhesives and coating compositions; and (e) incorporating the component into an article of footwear.

22 Claims, 2 Drawing Sheets

(56) References Cited

U.S. PATENT DOCUMENTS

| | | | | |
|---|---|---|---|---|
| 5,865,902 | A | 2/1999 | Yam et al. | |
| 6,113,475 | A * | 9/2000 | Masuda et al. | 451/76 |
| 6,390,898 | B1 | 5/2002 | Pieper | |
| 7,249,994 | B2 | 7/2007 | Sommacal | |
| 2003/0224704 | A1 | 12/2003 | Shank | |
| 2004/0168348 | A1 * | 9/2004 | Strickland | 36/19.5 |
| 2010/0050470 | A1 * | 3/2010 | Hubner | 36/14 |

* cited by examiner

SODIUM BICARBONATE PUCK CLEANING AND PAINTING

FIELD

The present invention is related to methods for manufacturing footwear, to methods of cleaning footwear components, and to processes of manufacturing footwear using cleaned footwear components.

BACKGROUND

This section provides background information related to the present disclosure but not necessarily prior art.

Various patents disclose blasting articles with sodium bicarbonate. Yam et al., U.S. Pat. No. 5,865,902 discloses a method and abrasive blast medium for cleaning contaminants from electronic hardware and teaches that, advantageously, the electronic hardware component cleaning compositions are water soluble and can readily be rinsed off. Winston et al., U.S. Pat. No. 5,332,447 discloses a blast media for stripping contaminant from a solid surface that comprises abrasive particles and a surfactant. The surfactant is said to reduce the amount of water-soluble residues remaining on the targeted surface and enhances the removal of dirt, grease, and oil from the surface. Kurtz, U.S. Pat. No. 5,322,532 discloses a blast media of agglomerated fine particles of sodium bicarbonate and sodium sesquicarbonate for stripping contaminants from a substrate. Yam et al., U.S. Pat. No. 5,316,587 discloses a blast media for stripping contaminants from a solid surface that comprises water-soluble abrasive particles and a surfactant that reduces the amount of water-soluble residues of blast media remaining on the targeted surface and enables any residues to be readily removed by fresh water. Yam et al., U.S. Pat. No. 5,308,404 discloses a blast media for stripping contaminants form very soft and sensitive substrates. Water-soluble blast media is preferred because it can be disposed of by a water stream. Yam et al., U.S. Pat. No. 5,308,403 discloses a blast media for stripping coatings or other contaminants from a solid surface that comprises water-soluble abrasive particles and a rise aid that reduces the amount of water-soluble residues of blast media remaining on the targeted surface and that enables any residues remaining to be readily removed by fresh water.

Footwear may include painted components. In addition, footwear assembly may include securing certain components using an adhesive.

SUMMARY

This section provides a general summary of the disclosure and is not intended as a comprehensive disclosure of the full scope of the invention or all of its features.

A component of footwear is prepared by (a) providing an unpainted component having a contaminant on a surface to which a coating is to be applied; (b) blast cleaning the surface by propelling with a pressurized gas stream an abrasive alkali, alkaline earth, or ammonium compound against the surface; (c) applying a pressurized gas stream free of the abrasive compound to the surface to remove any residual abrasive compound, wherein no liquid water or organic liquid is applied to the surface, to produce a cleaned surface; and (d) applying a coating to the cleaned surface.

An article of footwear is made by (a) providing a component having a contaminant on a receiving area of a surface; (b) blast cleaning the receiving area of the surface by propelling an abrasive alkali, alkaline earth, or ammonium compound in a pressurized gas stream against the receiving area; (c) applying a pressurized gas stream free of the abrasive compound to the receiving area to remove any residual abrasive compound from the receiving area of the surface, wherein no liquid water or organic liquid is applied to the receiving area of the surface, to produce a cleaned receiving area; (d) applying a layer of material to the cleaned receiving area, wherein the material is selected from the group consisting of adhesives and coating compositions; and (e) incorporating the component into an article of footwear.

Also disclosed are embodiments of these methods in which the abrasive compound is a potassium or sodium carbonate or bicarbonate, such as sodium bicarbonate ($NaHCO_3$).

Also disclosed are such methods in which the an abrasive alkali, alkaline earth, or ammonium compound has an average particle size of from about 20 micrometers to about 500 micrometers or has a Mohs hardness of up to about 5.0, or both.

Also disclosed are such methods in which the component is a molded article and such methods in which the contaminant is from a molding process.

Also disclosed are such methods in which the component is an outsole or midsole component.

The disclosed methods make it possible to paint or apply adhesive to polymeric components in shoe manufacturing without first cleaning the components with organic solvents and without washing the parts with water after cleaning. Thus, the disclosed processes offer significant advantages in cost savings, safety, and prevention of emissions and waste cleaning materials.

Further methods and modifications will become apparent from the detailed description and drawings, which are provided for purposes of illustration only and are not intended to limit the scope of the claims to the invention.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure.

It will be apparent to those skilled in the art that specific details need not be employed, that example embodiments may be embodied in many different forms and that neither should be construed to limit the scope of the disclosure. In some example embodiments, well-known processes, well-known device structures, and well-known technologies may not be described in detail.

The terminology is for the purpose of describing particular example embodiments only and is not intended to be limiting. As used in this document, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, steps, elements, components, and/or groups thereof. It is also to be understood that additional or alternative method steps may be employed. Throughout this disclosure, the numerical values represent approximate measures or limits to ranges to encompass minor deviations from the given values and embodiments having about the value mentioned as well as those having exactly the value mentioned. Other than in the working examples provides at the end of the detailed description, all numerical values of parameters (e.g., of quantities or conditions) in this specification, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, disclosure of ranges includes disclosure of all values and subdivided ranges within the entire range.

DRAWINGS

The drawings described herein are for illustrative purposes only of selected embodiments and not all possible implementations, and are not intended to limit the scope of the present disclosure or claimed invention.

Corresponding reference numerals indicate corresponding parts throughout the several views of the drawings.

DETAILED DESCRIPTION

Figure 1:
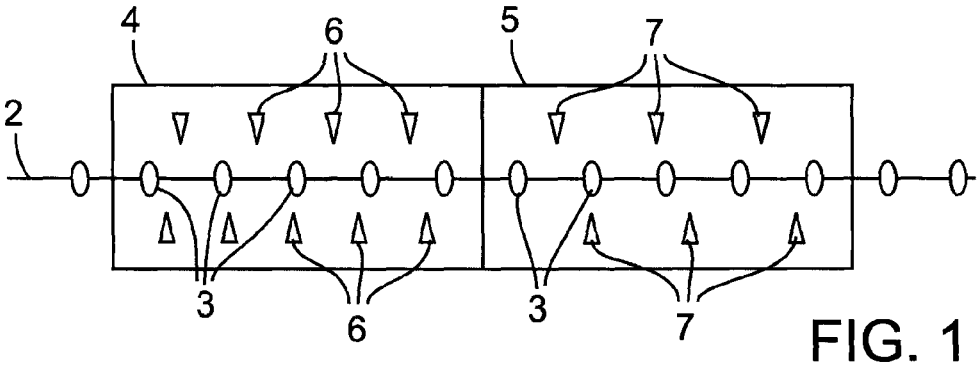
FIG. 1 is a schematic of a line cleaning footwear components according to the process.
Figure 2:
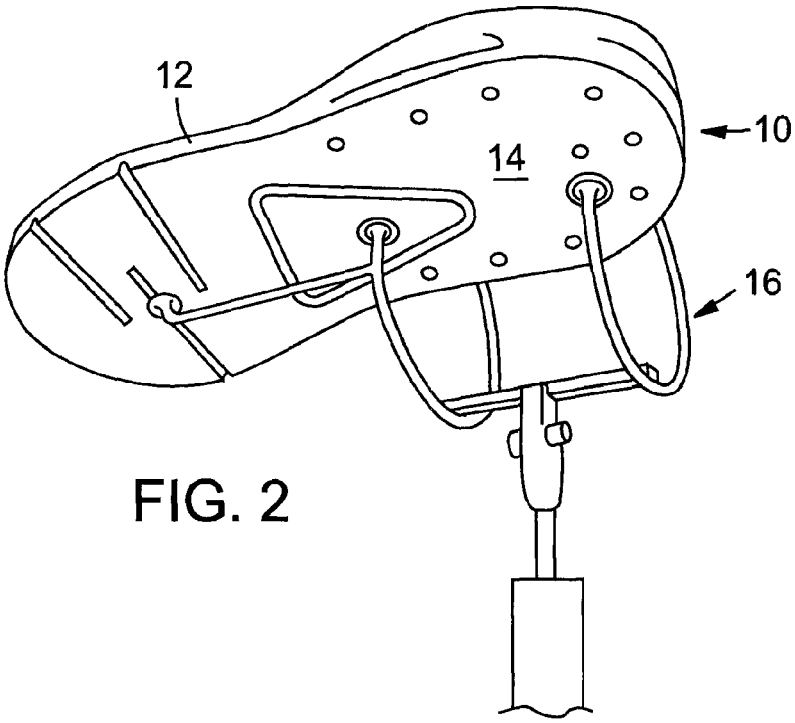
FIG. 2 is a perspective view of an exemplary midsole mounted for cleaning in the process.

The component of footwear may be any having a contaminant on a surface to be removed. Such components may be, as nonlimiting examples, an outsole or a component used in making an outsole such as a heel, a toe reinforcement, or a midfoot or heel support or a component that supports midfoot or heel movement such as an injection shank and plate; a midsole or a component incorporated into a midsole such as a cushioning device that serves to attenuate the force of impact to the wearer, where such a cushioning device may include one or more pillar elements, an airbag enclosure, or a mechanical cushioning device; or a component of a footwear upper such as a reinforcement for an eyelet for a shoelace, a reinforcement for a flex region of the vamp forefoot region, a decorative element, or other such footwear components.

The material from which the component of footwear is formed depends upon the particular component. Examples of typical materials for the outsole or parts of the outsole include rubbers including synthetic rubbers, thermoplastic elastomers, and other thermoplastic polymers such as vinyl polymers. Examples of typical materials for midsole elements include thermoplastic elastomers, other thermoplastic polymers, and thermoset materials, including foamed and nonfoamed polyurethanes and vinyl polymers. Examples of typical materials for the upper elements include polymers such as nylons, polyesters, leather, synthetic leather, rubber, textiles, polymer foams, thermoplastic polymers, and metals such as aluminum.

The component is cleaned to remove a contaminate from a surface that will be painted or adhered with an adhesive to another component in manufacture of the article of footwear. The nature of the contaminant can vary according to the component, its method of manufacture, and its handling before manufacture of the article of footwear. The various polymeric components used in making the article of footwear may be formed in a molding, extrusion, welding, laminating, three-dimensional printing, and laser sintering operations. The polymeric component may have a surface contaminant as a result of the forming operation, e.g. a mold release agent from a molding process. In the case of a metal component, the surface may have an oil to passivate the surface and prevent oxidation before painting. In other examples, the source of the contaminant may be environmental, from handling or storage, or other may be on the surface for other reasons.

One or more surfaces or a receiving area of a surface of the component is or are cleaned of a contaminant by propelling with a pressurized gas stream an abrasive alkali, alkaline earth, or ammonium compound against the receiving area of the surface, the whole surface, or more than one surface of the component. Nonlimiting examples of suitable abrasive alkali, alkaline earth, or ammonium compounds include sodium, potassium, and ammonium chlorides, chlorates, carbonates, bicarbonates, sulfates, and sulfites. Specific useful examples of these include sodium bicarbonate, sodium sesquicarbonate, trona, potassium bicarbonate, ammonium bicarbonate, sodium carbonate, potassium carbonate, potassium sulfate, sodium chloride, and sodium sulfate, including anhydrous and hydrated forms of these. The blasting media may consist of sodium bicarbonate alone.

The alkali, alkaline earth, or ammonium compound is used in a powdered form. In various embodiments, the powder has an average particle size in the range from about 10 to about 1,000 micrometers in diameter. In various embodiments, the powder may have an average particle size in the range from about 20 to about 500 micrometers in diameter. The particles may have a Mohs hardness of up to about 5.0. Typically, the particles have a Mohs hardness of about 1.0 to about 5.0; in some cases, particles having a Mohs hardness less than 3.0 could be used, in particular for cleaning softer materials.

The abrasive compound particles are applied in a dry blasting technique that involves directing the abrasive particles to a surface by means of a pressurized gas stream, which may be pressurized air or another gas such as nitrogen. The pressurized gas stream typically ranges from about 0.5 to about 10 kg-force/cm$^2$, and in particular embodiments from about 2 to about 6 kg-force/cm$^2$. The flow rate for the abrasive compound may range from about 0.5 to about 5 kg/min. In general, the pressurized air and abrasive particles are directed to the one or more surfaces or a receiving area of a surface via one or more nozzles that can be aimed as desired. In this way, all or substantially all of the desired area may be cleaned by moving the component between a plurality of nozzles, past a series of a plurality of nozzles, or in some combination selected to suit the area being cleaned. For example, a curved surface or multiple sides of a part may be cleaned effectively by positioning a plurality of independently positioned nozzles to deliver an effective amount of the pressurized flow of abrasive particles to all of the desired surfaces as the article moves along in front of the nozzles. The number of nozzles used will depend upon the surface area, size of the nozzles, spray pattern, configuration of the component, and may depend on other factors, and can be optimized by straightforward testing. In general, the contaminant in a particular area may be effectively removed within 10 seconds for the pressures and flow rates mentioned (from about 0.5 to about 10 kg-force/cm$^2$, from about 0.5 to about 5 kg/min), and typically within 5 seconds for the pressures and flow rates mentioned.

Following application of the abrasive compound, a pressurized gas stream is applied to the area cleaned to remove any residual abrasive compound. No liquid water or organic liquid is applied to remove any residual abrasive compound from the area cleaned. Thus, the footwear component is not rinsed with water or an organic liquid after the blast cleaning, but instead is used in the next step of the process without any rinsing to remove any residue of the sodium bicarbonate cleaning particles. This is advantageous in that it is not necessary to expend energy or time in drying the component before applying the coating or adhesive to the cleaned surface or area of the surface. The residual abrasive compound particles may be removed with the same pressurized gas as is used in the dry blasting step by which the surface is cleaned with the abrasive compound, or a different pressurized gas is used. Pressurized air or nitrogen may be used, for example. The pressurized gas stream for removing residual abrasive compound typically ranges from about 0.5 to about 10 kg-force/$cm^2$, and in particular embodiments from about 1 to about 6 kg-force/$cm^2$, and it may be less than the pressure with which the abrasive compound particles are blasted during cleaning, e.g., from about 1 to about 5 kg-force/$cm^2$. In general, the pressurized gas stream used to remove residual abrasive compound may be applied to the surface for about the same length of time as the abrasive compound is applied to the surface, such that components may be blasted with the abrasive compound and air cleaned of residual abrasive compound sequentially in a continuous operation. For example, the pressurized gas stream used to remove residual abrasive compound may be applied to the surface for up to about 10 seconds, and in certain embodiments for up to about 5 seconds.

Following the blasting and removal of residual abrasive compound, a coating or adhesive is applied to the cleaned surface, surfaces, or area(s) of the surface of the footwear component. The coating or coatings applied to the footwear component can be of any compositions that may be used to form adhering coating layers on the footwear component. A first applied coating layer may be a primer layer. A second coating layer of a desired color may be applied over the primer layer. In various embodiments the first applied layer is an aqueous coating composition. Suitable examples of coating compositions that may be used are disclosed in Rearick et al., US Patent Application Publication Nos. 2006/0141228 and 2006/0141234 and Yakulis et al., US Patent Application Publication No. 2010/0076143, the entire contents of which are incorporated herein by reference. In one embodiment the edges (also known as "sidewalls") of a midsole are coated. In another embodiment the outer surfaces of support pillars of a cushioning device are painted. In a third embodiment the surface of a air bag (which will be incorporated in a midsole to provide cushioning) is painted.

Adhesive may be applied to a surface of the cleaned component instead of, or in addition to, the coating layer. An adhesive that may be applied may be any known to be suitable for adhering the different components during footwear manufacture. The adhesive may be a reactive adhesive, such as a urethane, epoxy, or polyimide two-part adhesive or a UV light-curing adhesive, or may be a single component or non-reactive adhesive such as a rubber adhesive, a polyvinylacetate adhesive, a hot-melt adhesive, or a pressure-sensitive adhesive. Many, even all, of the components may be joined by an adhesive in making an article of footwear. As nonlimiting examples, an upper may be joined to a midsole with an adhesive; a midsole may be joined to an outsole with an adhesive; an upper may be joined to an outsole with an adhesive; and a cushioning device may be joined to a plate with an adhesive.

The component is then incorporated into an article of footwear, which may be done according to any of the usual methods.

Example embodiments will now be described with reference to the accompanying drawings.

FIG. 1 schematically depicts a line 2 having spaced components 3 that are advanced through a blast cleaning enclosure 4 and an enclosure 5 for removing residual abrasive compound from the components 3 using a pressurized gas stream. Cleaning enclosure 4 contains a plurality of nozzles 6 through which the pressurized gas stream containing an abrasive alkali, alkaline earth, or ammonium compound is sprayed toward the components 3 passing in front of the nozzles 6. The number of such nozzles 6, their positions in the enclosure 4, and the direction in which they are aimed may depend upon the size and shape of the component being cleaned, the area or areas being cleaned on the component, how such areas are situated, the amount and types of contaminant being cleaned from the component, and the like, and can be optimized in a straightforward manner. In enclosure 5, a plurality of nozzles 7 deliver pressurized air to remove residual abrasive compound from the surface of the components as they pass through enclosure 5 in front of nozzles 7. Line 2 as shown in FIG. 1 may, for example, a chain, belt or other continuous carrier onto which are attached jigs onto which components may be mounted as space components 3 and moved along with line 2 through enclosures 4,5, after which the cleaned components are removed from the jigs and replaced with components yet to be cleaned before the jig is again pulled with line 2 through enclosures 4,5. Line 2 may be longer or shorter than shown in FIG. 1; if longer, other actions may be performed on the components before or after the component passes through enclosures 4,5, for example the component may be painted or have an adhesive applied to it after leaving enclosure 5.

Figure 3:
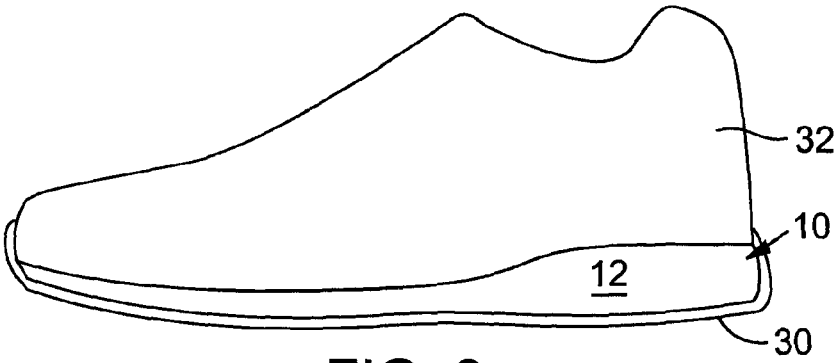
FIG. 3 is a side elevational view of an article of footwear incorporating the midsole of FIG. 2.

With reference to FIGS. 2-6, example footwear components midsole 10 and cushioning device 20 may be mounted on jigs 16 and 26, respectively. Midsole 10 has bottom 14 and sidewall 12, either or both of which may be cleaned by the process. The bottom 14 may be cleaned for application of an adhesive attaching the bottom 14 to an upper side of an outsole 30 during footwear manufacture. The top of the midsole, not shown in the figure, may be cleaned as well for application of an adhesive to attach the midsole to an upper. Sidewall 12 may be cleaned to have a coating layer applied. When incorporated into an article of footwear as shown in FIG. 3, midsole 10 will lie between outsole 30 and upper 32. Sidewall 12 will be visible in the finished article of footwear so that a paint layer on sidewall 12 may be provided for aesthetics or for protection. The midsole mounted on jig 16 may be the component 3 connected to line 2. The nozzles 6 and 7 may be directed to propel the abrasive compound, then pressurized air against the sidewall edge 12 to clean it before the sidewall 12 is painted. In addition, or alternatively, nozzles 6 and 7 may be directed to propel the abrasive compound, then pressurized air against one or both of the bottom 14 or top (not shown, but on the opposite side of midsole 10) to clean it or them before applying adhesive to attach the midsole to another shoe component or components during footwear assembly.

Figure 4:
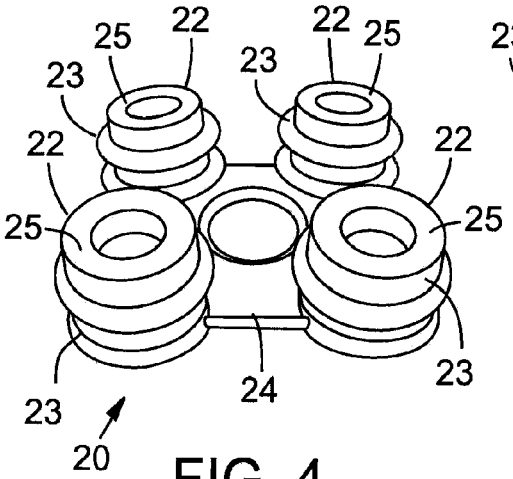
FIG. 4 is a perspective view of an exemplary footwear cushioning device.
Figure 5:
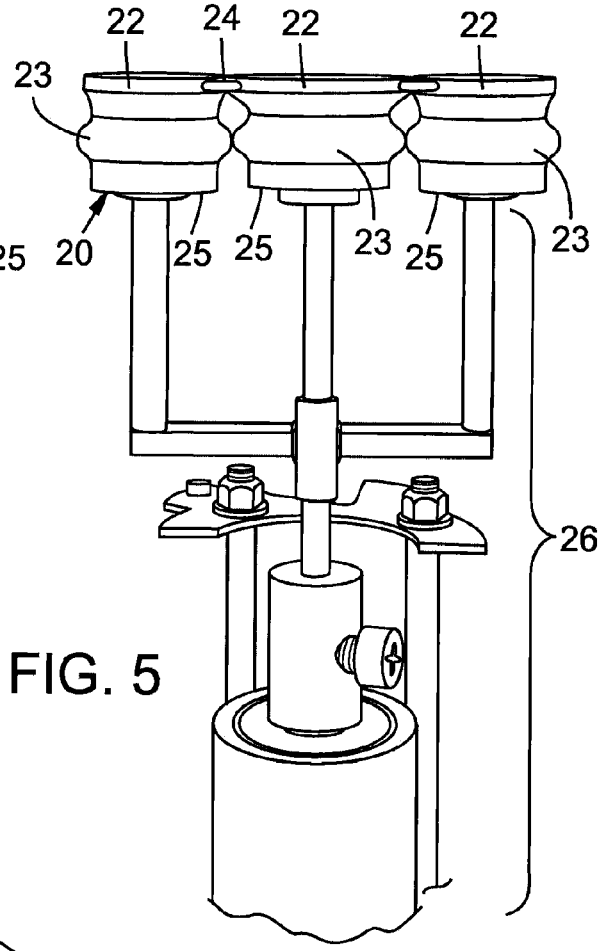
FIG. 5 is a perspective view of the cushioning device of FIG. 4 mounted for cleaning in the process.
Figure 6:
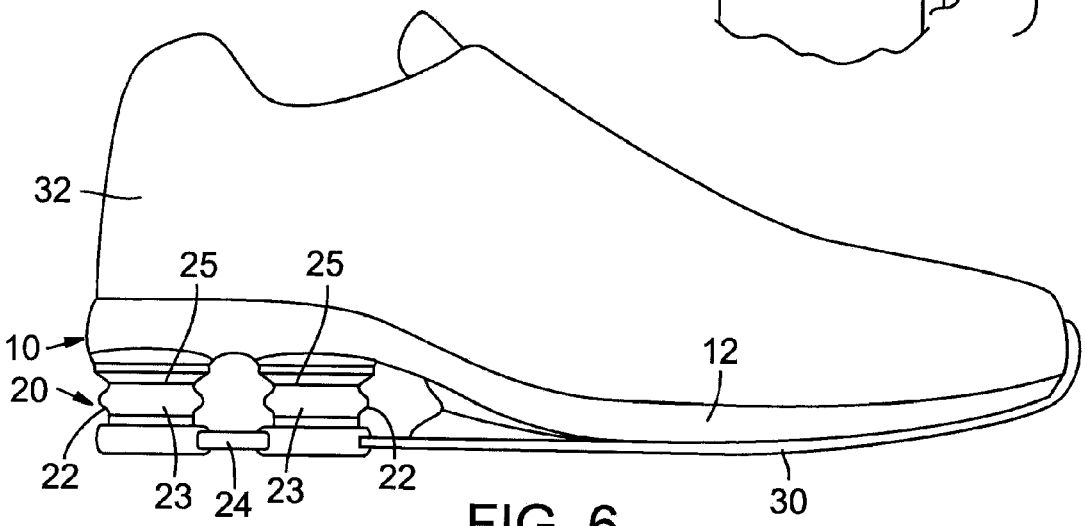
FIG. 6 is a side elevational view of an article of footwear incorporating the cushioning device of FIG. 4.

As depicted in FIGS. 4-6, cushioning device 20 may include a plurality of pillars 22 connected by pieces 24. Cushioning device pillars may have shapes other than those shown, and may have uniform or varying cross-sections along their lengths; and, as nonlimiting example, may be uniform along their lengths or include bulging or flared portions as in FIGS. 4-6, may have any of a number of cross-ections along their lengths including generally circular cross-sections or other geometric cross-sections such as square, pentagonal, triangular, parallelogram, five- or six-point star, or irregular cross-sections to mention a few possibilities. A cushioning device may include one, two, three, four, or more pillars of the same or different shapes with the same, similar, or different cross-sectional dimensions, and so on. Sides 23 of pillars 22 of cushioning device 20 may be cleaned in the method and painted before being assembled into an article of footwear as shown in FIG. 6, where the painted sides of pillars 22 will be visible. Cushioning device 20 can be set on or attached onto jig 26 as the component 3 connected to line 2. The nozzles 6 and 7 may be directed to propel the abrasive compound, then pressurized air against the sides 23 to clean them before they are painted painted. After painting, cushioning device can be assembled into an article of footwear connected below midsole 10 and to outsole 30. In addition or alternatively, nozzles 6 and 7 may be directed to clean top edges 25 of pillars 22 to prepare them to receive an adhesive.

Returning again to FIG. 1, although not shown, the enclosures 4,5 may advantageously be connected to a vacuum line to recover the abrasive compound powder, which can be collected, treated as needed such as by being filtered, then reused. Thus, a supply vessel of the abrasive compound powder may be used to supply lines leading to nozzles 6, while a vacuum line drawing the expended abrasive compound powder from enclosures 4,5 collects the abrasive compound powder. The collected powder may optionally be treated (e.g., filtered), then reloaded into the supply vessel.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

Disclosed are embodiments of a method of making an article of footwear, comprising: (a) providing a component having a contaminant on a receiving area of a surface; (b) blast cleaning the receiving area of the surface by propelling an abrasive alkali, alkaline earth, or ammonium compound in a pressurized gas stream against the receiving area; (c) applying a pressurized gas stream free of the abrasive compound and free of liquid water or organic liquid to the receiving area to remove any residual abrasive compound from the receiving area of the surface to produce a cleaned receiving area; (d) applying a layer of a material to the cleaned receiving area, wherein the material is selected from the group consisting of adhesives and coating compositions; and (e) incorporating the component into an article of footwear. The embodiments of this method include those having one or any combination of more than one of these features: (1) wherein the abrasive compound is a potassium or sodium carbonate or bicarbonate; (2) wherein the abrasive compound has an average particle size of from about 10 to about 1,000 micrometers or has a Mohs hardness of up to about 5.0, or both; (3) wherein the component is a molded article (4) wherein the component is an outsole or midsole or part thereof or wherein the component is a cushioning device or a part of a cushioning device; (5) wherein the contaminant is a mold release agent or an oil; (6) wherein the material is an adhesive or a coating composition; (7) wherein the pressurized gas stream of step (b) has a pressure of from about 0.5 to about 10 kg-force/cm$^2$, and the flow rate for the abrasive compound is from about 0.5 to about 5 kg/min; (8) wherein the pressurized gas stream of step (c) has a pressure of from about 0.5 to about 10 kg-force/cm$^2$; and (9) wherein the abrasive compound is recovered after step (b), filtered, and used to blast clean a further component, including all values and endpoints of numerical ranges and combinations thereof and all materials and combinations of materials disclosed above that may be included in compositions.

Disclosed are embodiments of a method of making a component of footwear, comprising: (a) providing an unpainted component of footwear having a contaminant on a surface to which a coating is to be applied; (b) blast cleaning the surface by propelling with a pressurized gas stream an abrasive alkali, alkaline earth, or ammonium compound against the surface; (c) applying a pressurized gas stream free of the abrasive compound, liquid water, and organic liquid to the surface to remove any residual abrasive compound to produce a cleaned surface; and (d) applying a coating to the cleaned surface. The embodiments of this method include those having one or any combination of more than one of these features: (1) wherein the abrasive compound is a potassium or sodium carbonate or bicarbonate; (2) wherein the abrasive compound has an average particle size of from about 10 to about 1,000 micrometers or has a Mohs hardness of up to about 5.0, or both; (3) wherein the component is a molded article; (4) wherein the component is an outsole or midsole or part thereof or wherein the component is a cushioning device or a part of a cushioning device; (5) wherein the contaminant is a mold release agent or an oil; (6) wherein the pressurized gas stream of step (b) has a pressure of from about 0.5 to about 10 kg-force/cm$^2$, and the flow rate for the abrasive compound is from about 0.5 to about 5 kg/min; (7) wherein the pressurized gas stream of step (c) has a pressure of from about 0.5 to about 10 kg-force/cm$^2$; and (8) wherein the abrasive compound is recovered after step (b), filtered, and used to blast clean a further component, including all values and endpoints of numerical ranges and combinations thereof and all materials and combinations of materials disclosed above that may be included in compositions.

As mentioned, all possible combinations of the enumerated optional features of these methods are specifically disclosed as embodiments.

What is claimed is:

1. A method of making an article of footwear, comprising:

(a) providing a component having a contaminant on a receiving area of a surface;

(b) cleaning the receiving area by blast cleaning the receiving area of the surface by propelling an abrasive alkali, alkaline earth, or ammonium compound having a Mohs hardness of less than 3.0 in a pressurized gas stream against the receiving area for a time selected to effectively remove the contaminant;

(c) applying a pressurized gas stream free of the abrasive compound and free of liquid water or organic liquid to the receiving area to remove any residual abrasive compound from the receiving area of the surface to produce a cleaned receiving area;

(d) applying a layer of a material to the cleaned receiving area, wherein the material is selected from the group consisting of adhesives and coatings; and then (e) incorporating the component into an article of footwear, wherein the component is made of polymer or metal and is selected from the group consisting of midsoles, components for midsoles, reinforcements for eyelets and flex regions of a vamp forefoot region, and decorative elements for uppers.

2. A method according to claim 1, wherein the abrasive compound is a potassium or sodium carbonate or bicarbonate.

3. A method according to claim 1, wherein the abrasive compound has an average particle size of from about 10 to about 1,000 micrometers.

4. A method according to claim 1, wherein the component is a molded article.

5. A method according to claim 1, wherein the component is a midsole or part thereof.

6. A method according to claim 1, wherein the contaminant is a mold release agent or an oil.

7. A method according to claim 1, wherein the component is a cushioning device or a part of a cushioning device.

8. A method according to claim 1, wherein the material is an adhesive.

9. A method according to claim 1, wherein the material forms at least one of a primer layer and a coating layer of a desired color.

10. A method according to claim 1, wherein the pressurized gas stream of step (b) has a pressure of :from about 0.5 to about 10 kg-force/$cm^2$, and the flow rate for the abrasive compound is from about 0.5 to about 5 kg/min.

11. A method according to claim 1, wherein the pressurized gas stream of step (c) has a pressure of from about 0.5 to about 10 kg-force/$cm^2$.

12. A method according to claim 1, wherein the abrasive compound is recovered after step (b), filtered, and used to blast clean a further component.

13. A method of making a component of footwear, comprising:

(a) providing an unpainted component of footwear selected from the group consisting of midsoles, components for midsoles, reinforcements for eyelets and flex regions of a vamp forefoot region, and decorative elements for uppers, wherein the component is made of a polymer or metal and wherein the component has a contaminant on a surface to which a coating is to be applied;

(b) blast cleaning the surface by propelling with a pressurized gas stream an abrasive alkali, alkaline earth, or ammonium compound against the surface;

(c) applying a pressurized gas stream free of the abrasive compound, liquid water, and organic liquid to the surface to remove any residual abrasive compound to produce a cleaned surface;

(d) painting a side of the component with a paint layer by applying a coating to the cleaned surface; and then (e) incorporating the component into an article of footwear, wherein the side with the paint layer is visible in the article of footwear.

14. A method according to claim 13, wherein the abrasive compound is a potassium or sodium carbonate or bicarbonate.

15. A method according to claim 13, wherein the abrasive compound has an average particle size of from about 10 to about 1,000 micrometers or has a Mohs hardness of up to about 5.0, or both.

16. A method according to claim 13, wherein the component is a molded article.

17. A method according to claim 13, wherein the component is midsole or part thereof.

18. A method according to claim 13, wherein the contaminant is a mold release agent or an oil.

19. A method according to claim 13, wherein the component is a cushioning device or a part of a cushioning device.

20. A method according to claim 13, wherein the pressurized gas stream of step (b) has a pressure of from about 0.5 to about 10 kg-force/$cm^2$, and the flow rate for the abrasive compound is from about 0.5 to about 5 kg/min.

21. A method according to claim 13, wherein the pressurized gas stream of step (c) has a pressure of from about 0.5 to about 10 kg-force/$cm^2$.

22. A method according to claim 13, wherein the abrasive compound is recovered after step (b), filtered, and used to blast clean a further component.

* * * * *